United States Patent [19]

Lopez

[11] Patent Number: 4,473,984

[45] Date of Patent: Oct. 2, 1984

[54] CURTAIN-WALL MASONRY-VENEER ANCHOR SYSTEM

[76] Inventor: Donald A. Lopez, 6406 Birchwood Ave., Baltimore, Md. 21214

[21] Appl. No.: 531,666

[22] Filed: Sep. 13, 1983

[51] Int. Cl.[3] ..... E04B 1/38; E04B 1/74

[52] U.S. Cl. ..... 52/410; 52/379; 52/434; 52/698; 52/713; 411/397; 411/400

[58] Field of Search ..... 52/713, 698, 562, 428, 52/410, 434; 411/388, 389, 387, 397, 400, 399, 378, 31

[56] References Cited

U.S. PATENT DOCUMENTS

| | | | |
|---|---|---|---|
| 1,392,703 | 10/1921 | Phillips . | |
| 1,798,468 | 3/1931 | Hartzler et al. | 52/713 X |
| 1,942,863 | 1/1934 | Johnstone | 52/713 X |
| 2,413,425 | 11/1946 | Anderson et al. . | |
| 2,999,571 | 9/1961 | Huber | 52/698 X |
| 3,292,336 | 12/1966 | Brynjolfsson et al. | 52/428 X |
| 3,341,998 | 9/1967 | Lucas | 52/379 |
| 3,353,312 | 11/1967 | Starch | 52/713 |
| 3,500,713 | 3/1970 | Bell | 411/387 |
| 4,021,990 | 5/1977 | Schwalberg | 52/714 |
| 4,108,560 | 8/1978 | Minogue | 411/389 X |
| 4,329,823 | 5/1982 | Simpson | 52/410 X |
| 4,350,464 | 9/1982 | Brothers | 52/698 X |

FOREIGN PATENT DOCUMENTS

| | | | |
|---|---|---|---|
| 231696 | 2/1911 | Fed. Rep. of Germany | 411/389 |
| 668487 | 3/1952 | United Kingdom | 52/562 |

OTHER PUBLICATIONS

ITT Phillips Drill Div. Catalog Sheets, pp. 8, 9, 16, 17-21, 22, 23, 24-29, 30, 31.

*Primary Examiner*—Alfred C. Perham
*Attorney, Agent, or Firm*—John F. McClellan, Sr.

[57] ABSTRACT

A curtain-wall masonry veneer anchor system provides tolerances for accommodating installation misalignment and similarly for accommodating in-service load stresses while at the same time preventing loosening in service, even when installed through sheathing/or insulation covering wall structure to which the system is affixed, such as a masonry wall or metal stud or structural steel. A threaded stud is provided, either coarse-threaded along the length for self-tapping in a pre-drilled hole in masonry, or self-drilling and self-tapping for one-operation affixation in steel studding or in structural steel; a fastener barrel has at one end a threaded hole receiving the stud and surrounded by teeth in a radial face arranged for routing away sheathing or insulation as the threaded stud screws into a wall, preventing crushed sheathing or insulation from causing loosening and backing out under service loads; novel tie configuration connects with an eye in the fastener barrel outer end and accommodates to the various rotational positions at which the fastener barrel may tighten in wall structure.

7 Claims, 7 Drawing Figures

CURTAIN-WALL MASONRY-VENEER ANCHOR SYSTEM

FIELD OF THE INVENTION

This invention relates generally to building construction and the like and specifically to an improved curtain-wall masonry-veneer anchor system.

SUMMARY OF THE INVENTION

In the field of building construction various fastening systems have been described, including those disclosed in the following U.S. patents:

U.S. Pat. No. 1,392,703 to J. H. Phillips, 10-4-21, disclosed a cylindrical tube with threaded interior and serrated end (FIGS. 7, 9 and 10);

U.S. Pat. No. 2,413,425 to J. E. Anderson et al, 12-31-46, disclosed a masonry anchor with an angled member 5 engaging a slotted member 7;

U.S. Pat. No. 3,341,998 to J. N. Lucas, 9-19-67, disclosed a masonry tie with lateral and vertical adjustment and pivotal connection; a wire tie of trapezoidal shape, all in one plane and with one axis of symmetry, is disclosed;

U.S. Pat. No. 3,353,312 to B. Storch, 11-1-67, disclosed a wire-and-slotted bracket vertical and lateral adjustment for an anchor 19 movable in the slot;

U.S. Pat. No. 4,021,990 to B. J. Schwalberg, 5-10-77, disclosed a slotted plate and wire adjustable veneer anchor system.

Anchors with circular holes for tie wires are available from ITT Phillips Drill Division, POB 364, Michigan City, Ind. 46460, as well as self-drilling anchors.

Self-drilling and self-tapping studs are known.

However, no system known to the present inventor overcomes all deficiences in fastener systems of the type improved-on by the present invention, among which deficiences can appear:

backing-out of fasteners, fastener loosening and movement caused by compressive deformation of sheathing;

two-fastener system deformation between anchors under load, installation inefficiency and fastener failure caused by inflexible fastener systems and, on the other hand, impositive connection between fastener and strucural element.

failure to transfer to the structural back-up system lateral forces imposed on the veneer, requirement for explosive driven fasteners, requirement for pre-forming holes in steel studs or structural steel elements one-half inch (13 mm) thick or less, lack of versatility in anchoring various types of cladding material and fixtures, unsuitability for use with cavity walls, or with some types of masonry veneers, slowness of installation, including difficulty, and or need for extensive on the spot assembly or other preparation, requirement for expensive special installation tools, fragility, weight, inconvenience and unwarranted complexity and expense.

OBJECTS OF THE INVENTION

Objects of the invention therefore are to provide a system as described that:

eliminates the problem of fasteners backing out from the structural element, eliminates movement caused by compressive deformation of sheathing in steel stud systems, eliminates deformation commonly found in anchor systems using two fasteners, allows for minor differential movement between the veneer and structural element in the vertical and horizontal planes, provides a positive connection between the fastener assembly and the structural element, provides superior transfer of lateral forces imposed on the veneer to the structural back-up system, eliminates need for explosive driven fasteners, eliminates need for predrilling, burning or welding in steel studs or structural steel elements up to one-half inch thick;

is adaptable for anchoring various cladding materials, walls elements, fixtures and equipment;

is effective for cavity wall anchoring requirements, is effective with all masonry veneers;

is fast, providing preassembled fastening assembly that installs in seconds, is easy and convenient to install, requiring only one hole per anchor, requires as special tools, only a chuck adapter, is reliable, economical, lightweight, tough, simple and safe.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
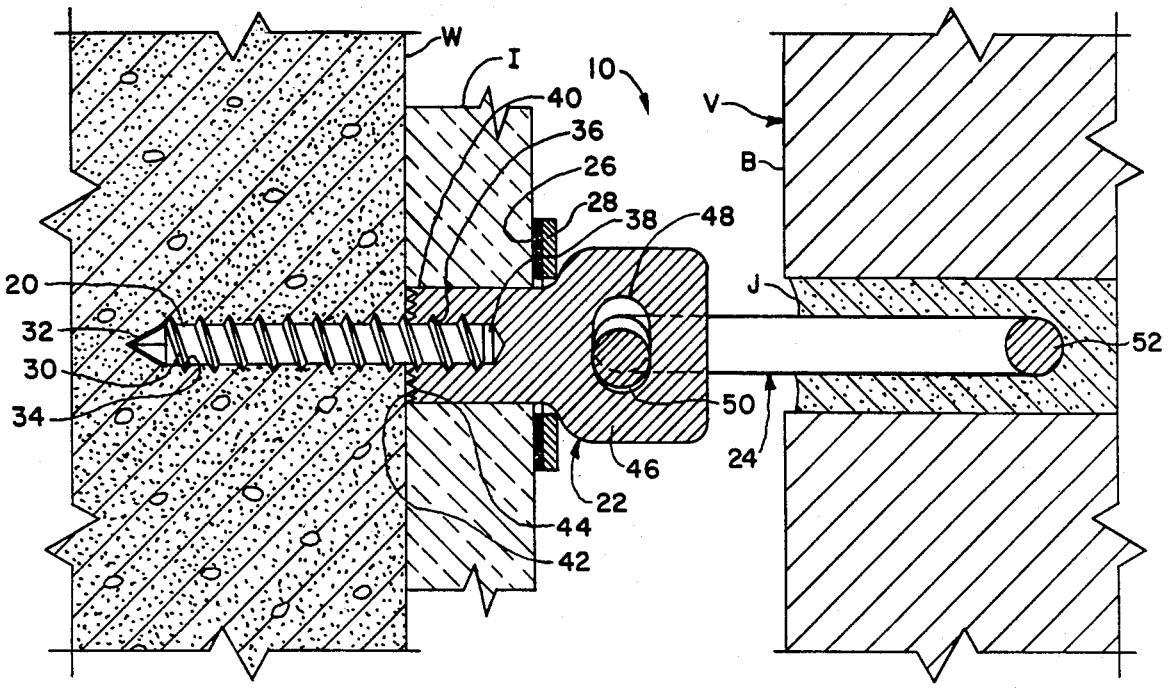
FIG. 1 is a sectional elevational diagram of a first embodiment installed, exaggerated for exposition.

FIG. 1 shows embodiment 10 of the system of the invention in a typical installation, anchoring a masonry veneer wall, in this case a brick veneer wall V, to a supportive masonry wall W covered with insulation I.

The invention permits workmen to install the system rapidly, with on drilling operation in a general area, wide tolerances being provided by easy adjustment, as result of the following configurations.

The embodiment comprises basically three elements: threaded stud 20 which is held and driven by fastener barrel 22, which holds wire tie 24.

As an option, a soft rubber or other elastomeric washer 26 and back-up rigid washer 28 which may be steel and held by the fastener barrel 22.

The threaded stud 20 is preferably of the self-tapping type with masonry thread 30 from end-to-end (except for point 32) that forms similar coarse threads 34 in a pre-drilled hoke, affixing the stud to the masonry wall.

Identical coarse female threads 36 are supplied in coaxial bore 38 in the cylindrical portion 40 of the fastener barrel 22. This enables it to screw-inward or drive the threaded stud, and use an economical, single pitch thread instead of a stud with two threads.

The fastener barrel 22 has a feature overcoming a problem of considerable structural and economic importance: compressive deformation of the sheathing, or insulation I against the masonry wall W, which can cause in-servie loosening of fastenings and also sheathing or insulation deterioration. To avoid the need for pre-counterbored sheathing or insulation which would dictate close tolerance drilling and could often result in awkward fastener-location, and to avoid the need for a separate counterboring operation, the system does the necessary counterboring automatically with no extra work and to the closest tolerance achievable by any other means. The end face 42 of the cylindrical portion 40 has a set of chisel-like teeth 44 on it, radiating from the tapped hole and abutting each other.

Not only does this toothed first end or end face of the fastener barrel counterbore the sheathing as it drives the threaded stud 20 but also it sets itself and the stud tightly, to prevent backing out.

The second end of the fastener barrel 22 is an eye 46 preferably symmetrical with the cylindrical portion 40 in two planes and with an aperture having two special characteristics: the eye aperture is a slot 48 transverse to the axis of the cylindrical portion 40 and the slot width is substantially the same as the cross-sectional diameter of the wire tie 24.

The wire tie has an adjustment-offset-part 50 that pivotally and slidably engages the eye 46, and at the opposite part an angled portion 52 for embedment during wall construction, in this case bricklaying, as in a mortar joint J between bricks B in the brick veneer V.

Co-action between the eye 46 and the wire tie 24 provides three adjustments;

(1) vertical adjustment to accommodate for differences between the level of the mortar joint and the axis of the fastener barrel, (2) horizontal adjustment to permit the wire tie to be adjusted laterally in the mortar joint, and (3) angle adjustment to permit the wire tie to be installed level in the mortar bed regardless of substantial lack of verticality of the eye 46 when it scrubs tight against the masonry wall. Verticality can be approximated in the tightening.

In the first adjustment, the wire tie 24 can ride up or down in the slot 48 about three wire diameters in distance on installation, and also in service for easing stresses under wind loads and other service loads.

In the second adjustment, the wire tie can be slid in a horizontal direction to center it when installed and, as before, can slide in a horizontal direction under service loads, without loosening.

Figure 2:
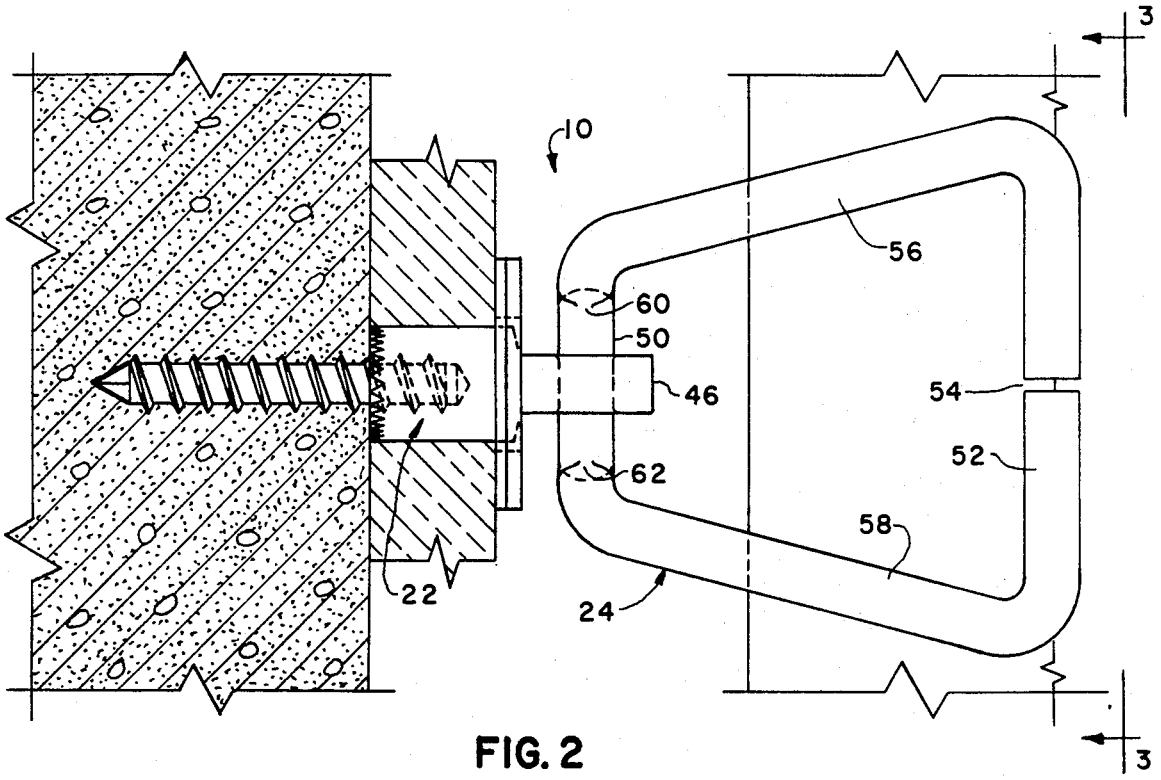
FIG. 2 is a partially sectional plan diagram corresponding to the FIG. 1 showing; with a portion less exaggerated.

FIG. 2 shows that for this sliding the wire tie 24 has as offset portion 50, a straight run about three times the thickness of the eye 46 and transverse to the axis of the threaded stud and the fastener barrel 22. Also shown in the somewhat longer angled portion 52 parallel with the other straight run engaging the mortar, preferably with an assembly break 54 in it, and connections 56, 58 of the ends of the parallel parts.

The third adjustment, also by means of offset 50, permits accommodation to lack of verticality of the eye, one of the inclined transitions 60, 62 at the ends of offset 50, will fit in the slot regardless of substantial incline of the eye and slot.

It is convenient to refer to each fastener barrel with a threaded stud in it, as a fastener, and to the complete assembly of fastener and tie as a fastener system.

In operation, the embodiment 10 system is assembled and installed as follows:

(a) a threaded stud 20 of appropriate type and length for the intended application is pre-assembled to each fastener barrel 22, and, if to be used, the washers 26, 28 may be preassembled;

(b) a chalk line is snapped across the sheathing S at each level on which fasteners are to be installed;

(c) a hole is drilled at each interval along the chalk lines at which a fastener is to be installed;

(d) a fastener is screwed into each hole reached in turn; for this a power drill with a solid chuck having a recess receiving eye 46 may be used; the chuck would be the only special tool needed;

(e) a tie 24 is installed and engaged with the mortar or equivalent material of the veneer wall. When a self-drilling threaded stud is used, as described below, the separate operation of hole drilling is eliminated.

Figure 3:
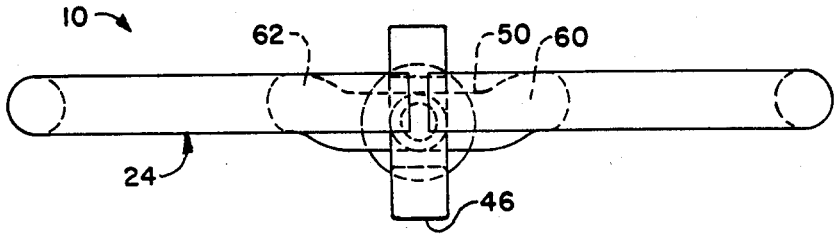
FIG. 3 is a view taken at 3—3, FIG. 2 of details shown in FIGS. 1 and 2.

FIG. 3, taken at 3—3, FIG. 2, shows the elevational relation of the inclined transition portions 60, 62 at the ends of the offset portion 50 to the rest of the wire tie 24 and to the eye 46, when centered with the eye vertical.

Figure 4:
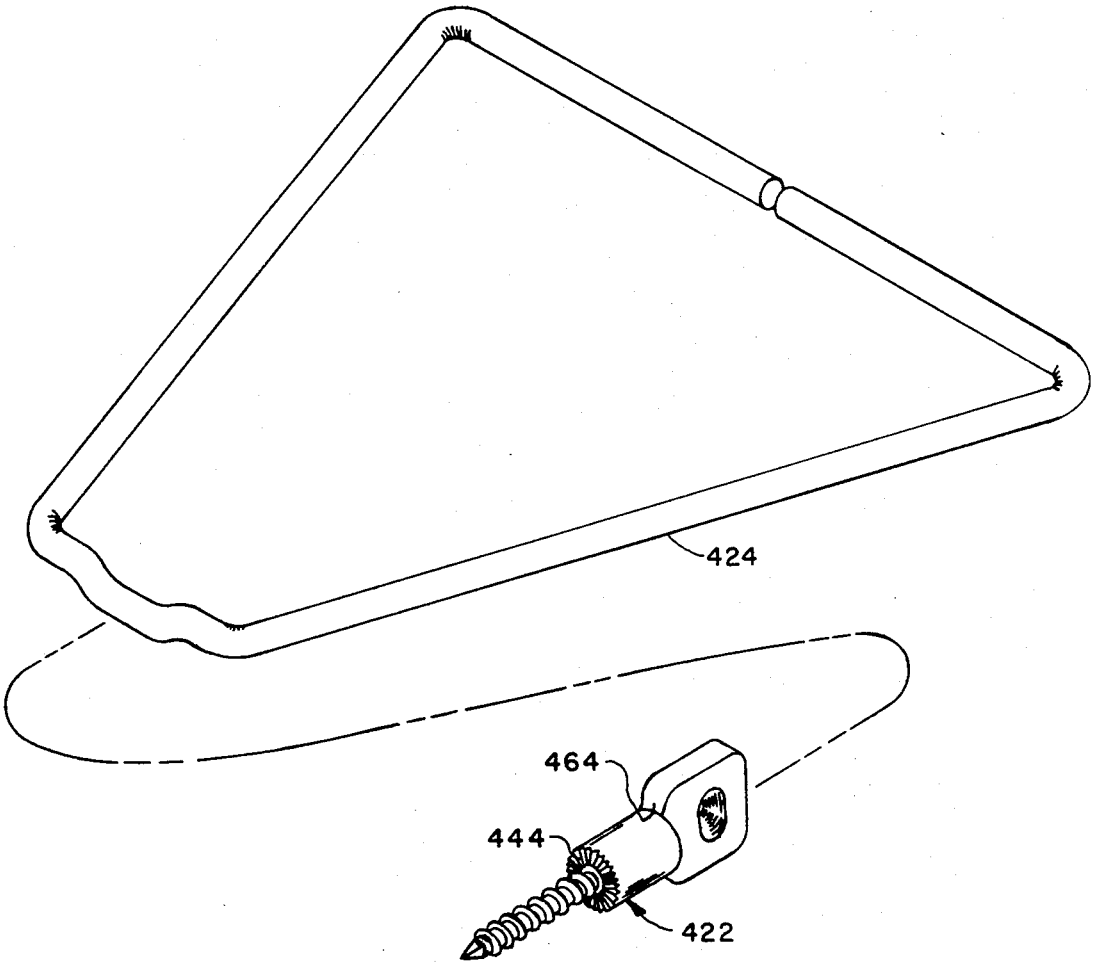
FIG. 4 is an exploded perspective view of elements from FIGS. 1-3 shown approximately in scale for one embodiment.

FIG. 4 shows in proportion one typical size and form wire-tie 424 and fastener barrel 422. Radial teeth show at 444. The shoulder 464 of the eye will serve as well to retain the washers in this embodiment as in the embodiment 10 of the previous Figures.

Figure 5:
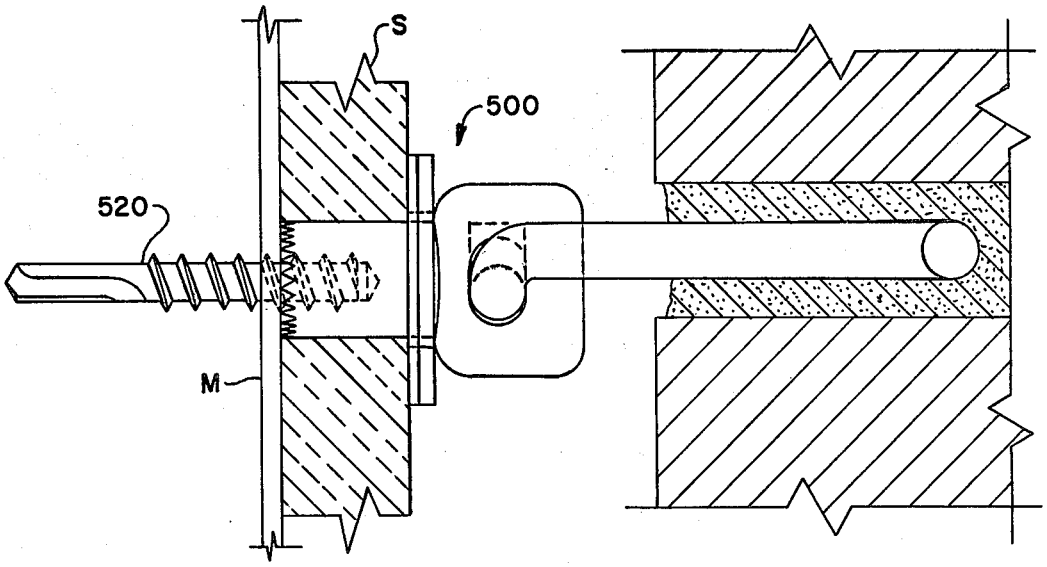
FIG. 5 is an exaggerated elevational diagram in partial section of a second embodiment installed.

FIG. 5 shows an embodiment 500, similar to the previous embodiments but with self-drilling, self-tapping stud 520 for one-operation installation in metal studding M, through sheathing S.

Figure 6:
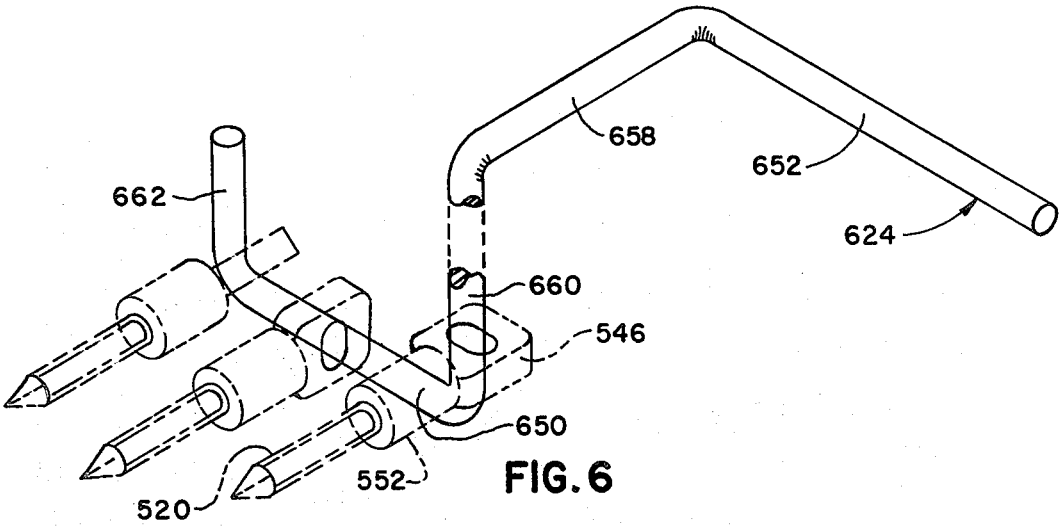
FIG. 6 is a perspective multi-position view with a third embodiment portion thereof exaggerated in width to illustrate positioning versatility.

FIG. 6 shows another form of wire tie 624, with integral mortar engaging horizontal arm 652 connected by a perpendicular horizontal arm 658 to a squared "U"-shape. The "U"-shape is shown too large in all directions, for exposition. It comprises a downward arm 660, a horizontal arm 650 parallel with the arm 652, and an upward arm 662.

Three positions of engagement of a typical fastener barrel 552 with stud 520 are indicated in phantom lines, indicating that with this type wire tie (horizontal "L"-shape having at right angles to it a depending squared-"U"-shape) every rotational position of an eye 546 can be accommodated.

Figure 7:
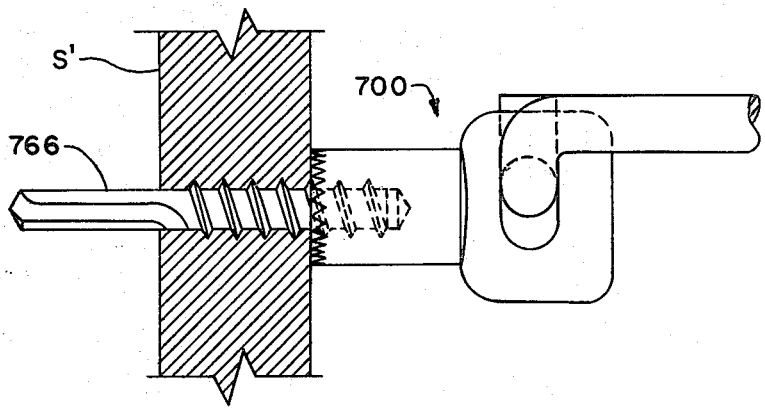
FIG. 7 is a partly sectional exaggerated fragmentary elevational detail.

FIG. 7 shows an embodiment 700 for connecting structural steel S' with a veneer wall or the like, not shown. The self-drilling portion of the threaded stud is made longer than the thickness of the steel stud S'.

It will be appreciated that all embodiments can tie masonry veneers and the like as well as brick veneers.

Materials may be:

stud-tempered carbon steel, plated;

fastener barrel-mild steel, plated, or stainless steel;

wire tie-mild steel plated, or stainless steel.

Plating can be any suitable conventional anti-corrosion type such as galvanizing.

From the above it will be seen that the system of this invention was specifically designed to fill the need for a positive lateral load connection between masonry veneer and the structural elements of various back-up systems which include: wood frame, steel stud, structural steel, masonry and concrete.

It will be seen also that it is capable of providing superior resistance to tension and compression resulting from forces perpendicular to the plane of the wall while permitting slight vertical and horizontal movement parallel to the plane of the wall to allow for differential movement.

Further, variations within the scope of one of ordinary skill in the art may provide maximum holding strength for the material used for the structural element, as well as self-drilling and self-tapping capability.

Still further, it will be appreciated that within the scope of one of ordinary skill in the art barrel element of the fastening assembly may be drilled and tapped to accommodate any type or size thread required. Similarly, the cutting teeth can be machined at the drilled and tapped end of the barrel to allow the fastening assembly best to penetrate various thicknesses and types of sheathing or insulation to provide positive contact with the structural element of the back-up system. This is particularly desirable and effective with the steel stud/gysum wallboard back-up system extensively used with brick veneer. The receiving slot for the tie in the expanded end of the barrel can be machined to accommodate many variations of wire or other type tyies; also, variations within the scope of one of ordinary skill in the art in the shape, material, and/or gage or diameter of the wire tie may provide even greater versatility with the system.

For purposes of the specification and claims the term "sheathing" can include rigid insulation.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a system for anchoring a masonry veneer wall to a supportive wall by means of a stud adapted for affixation in the supportive wall and stud-holding means having an eye engaging a first part of a wire-tie having a second part adapted for embedment by cementitious material of the veneer wall, the improvement comprising: said stud adaptation including the stud having means for self-threading screwing in a hole in the supportive wall, the stud-holding means having a face for tightening against said wall upon said screwing; means permitting adjustment of said anchoring, including: the eye of the stud-holding means having a slot transverse to the axis of the stud and having a portion with substantially uniform width, and the wire-tie having a cross-sectional diameter substantially the same as said substantially uniform width.

2. In a system as recited in claim 1, the supportive wall being of the type having sheathing thereon, and the improvement further comprising means minimizing crushing of said sheathing, including said face of the stud-holding means having toothed means for counterboring a hole through the sheathing upon said screwing.

3. In a system as recited in claim 1, the means for self-threading screwing comprising screwthreads, and same screw threads extending into a threaded bore in the stud-holding means, for holding the stud.

4. In a system as recited in claim 1, means for accommodating to various rotational orientations of said slot, comprising the wire tie having an offset portion between inclined portions, at said slot.

5. In a system as recited in claim 4, the wire tie having substantially a trapezoidal shape with said offset portion being a parallel side of said trapezoidal shape.

6. In a system as recited in claim 4, said offset portion being in squared-"U"-shape and depending integrally from a horizontal "L"-shape.

7. In a system as recited in claim 1, said supportive wall having a steel component, and said stud adaptation further including means for one-operation attachment of said system to said steel component, comprising said stud provided with a self-drilling end.

* * * * *